United States Patent [19]

Pangborn et al.

[11] 3,955,556

[45] May 11, 1976

[54] CATALYTIC FLUID HEATER

[75] Inventors: Jon B. Pangborn, Lisle; John C. Sharer, Evanston, both of Ill.

[73] Assignee: Institute of Gas Technology, Chicago, Ill.

[22] Filed: July 17, 1974

[21] Appl. No.: 489,402

Related U.S. Application Data

[63] Continuation-in-part of Ser. No. 443,128, Feb. 15, 1974, abandoned.

[52] U.S. Cl. ..... 126/362; 126/350 R; 122/4 D; 122/37; 23/288 F; 431/268

[51] Int. Cl.[2] ..... F24H 1/00

[58] Field of Search ..... 126/361, 362, 350 R, 126/360, 391; 122/37, 165, 4 D; 23/288 K, 288 L, 288 M; 431/268; 137/571, 575

[56] References Cited

UNITED STATES PATENTS

| | | | |
|---|---|---|---|
| 461,867 | 10/1891 | Flanders | 126/350 R |
| 1,129,870 | 3/1915 | Jarvis | 122/165 |
| 2,521,538 | 9/1950 | Rees | 23/288 L |
| 2,778,610 | 1/1957 | Bruegger | 122/4 D X |
| 2,839,048 | 6/1958 | Jacklin, Jr. | 126/350 R |
| 2,856,905 | 10/1958 | Bowen | 122/4 D X |
| 3,538,908 | 11/1970 | Weil | 431/268 X |

*Primary Examiner*—William F. O'Dea
*Assistant Examiner*—Harold Joyce
*Attorney, Agent, or Firm*—Dominik, Knechtel, Godula & Demeur

[57] ABSTRACT

A catalytic fluid heater formed of a number of nested fluid heating chambers spaced from one another to provide therebetween a heating zone having a chimney effect such that a mixture of fuel gas and air is caused to flow through the heating zone from the bottom to the top thereof. A catalyzed surface is disposed in contact with the walls of adjacent ones of the fluid heating chambers. A fuel gas, preferably hydrogen, is delivered to the heating zones, mixed with air and combusted on the catalyzed walls. The combustion product, in such cases, is primarily water vapor, so that external venting is not required.

8 Claims, 5 Drawing Figures

CATALYTIC FLUID HEATER

This application is a continuation-in-part of copending U.S. Pat. application, Ser. No. 443,128, filed Feb. 15, 1974, now abandoned.

This invention relates to an improved catalytic fluid heater. More particularly, it relates to an improved catalytic fluid heater which does not require external venting, or the use of electrical energy.

Conventional gas fired fluid heaters, particularly home water heaters, normally require external venting and hence special chimney constructions which add materially to building costs. The catalytic fluid heater of the present invention, although gas fueled, is fueled with hydrogen, reformed natural gas, or low carbon monoxide content manufactured gas, in a fashion such that no venting is required because the combustion products are innocuous. In fact, the combustion product of the catalytic fluid heater is steam which can be utilized either to humidify a building or condensed to produce a distilled quality water. The catalytic fluid heater further is self-igniting and hence requires no standing pilots and need not consume fuel gas during periods of nil heat demand, as with conventional gas fired fluid heaters. The catalytic reaction is self-starting so that the heat or temperature sensing device need only be linked to the fuel gas supply valve to operate the latter to supply fuel to it.

Accordingly, it is an object of the present invention to provide an improved catalytic fluid heater.

More particularly, it is an object to provide an improved catalytic fluid heater which combusts hydrogen and other gases which are righ in hydrogen such as manufactured gas and reformed natural gas. In addition, it combusts the small amounts of methane and carbon monoxide that might be contained in these fuel gases.

More particularly still, it is an object to provide an improved catalytic fluid heater which, although gas fueled, does not employ flame combustion, does not require electrical energy, and does not require external venting.

Other objects of the invention will in part be obvious and will in part appear hereinafter.

For a fuller understanding of the nature and objects of the invention, reference should be had to the following detailed description taken in connection with the accompanying drawings, in which.

Similar reference characters refer to similar parts throughout the several views of the drawings.

Figures 1, 2:
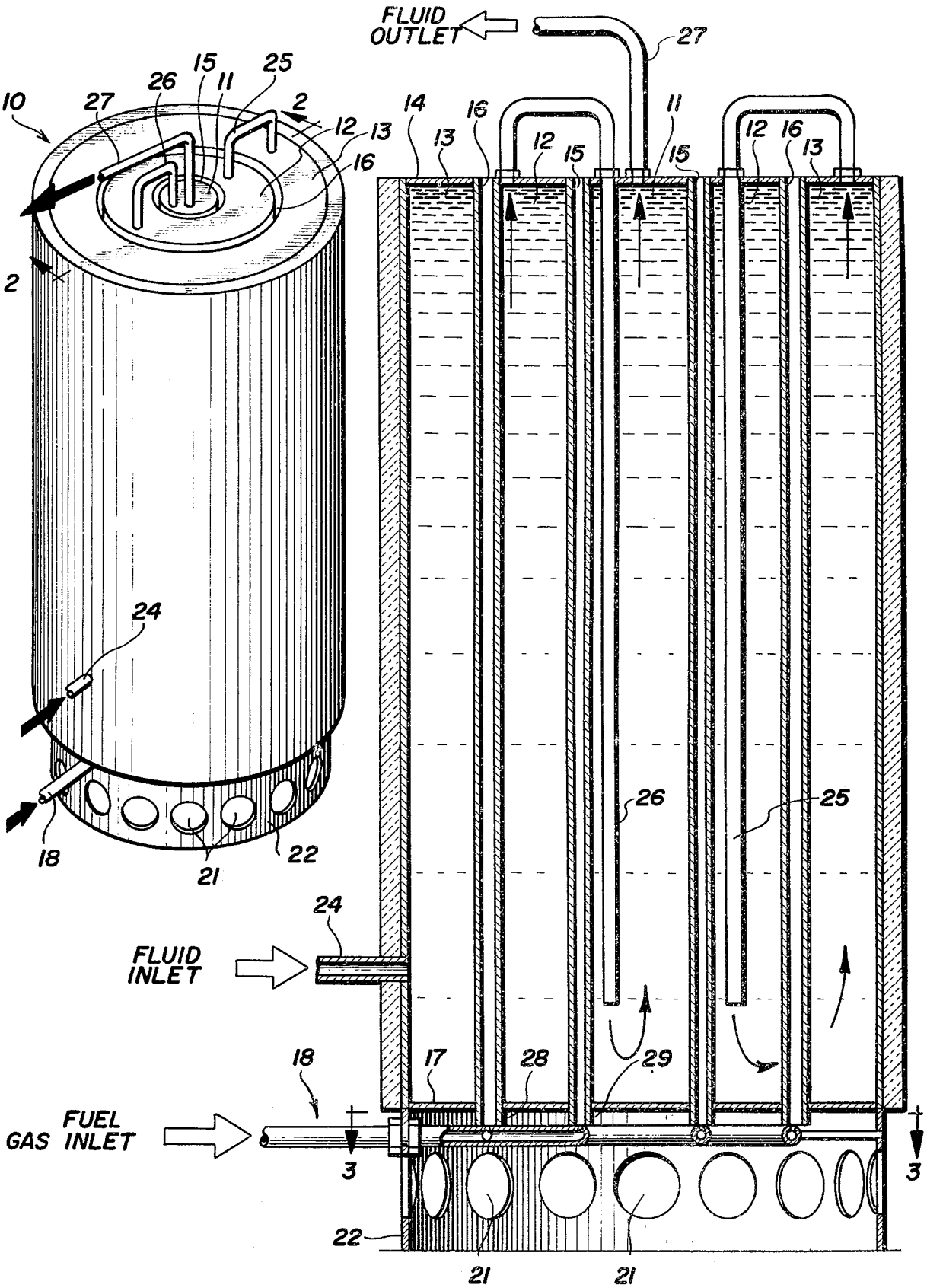
FIG. 1 is a perspective view of a catalytic fluid heater exemplary of the invention.
FIG. 2 is a sectional view taken along lines 2—2 of FIG. 1.
Figure 3:
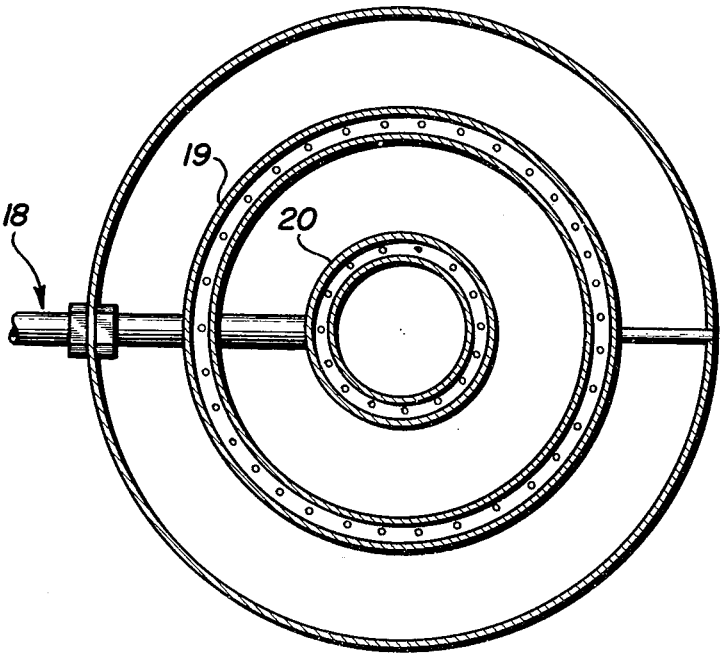
FIG. 3 is a sectional view taken along lines 3—3 of FIG. 2.
Figure 5:
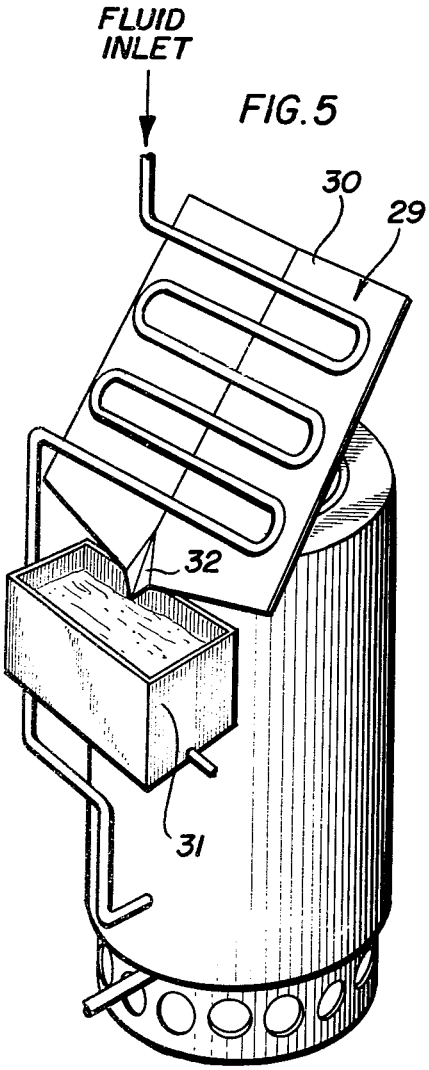
FIG. 5 is a perspective view of the catalytic fluid heater generally illustrating the manner in which the distilled water can be collected.

Referring now to the drawings, a catalytic fluid heater 10 is illustrated and the same can be seen to include circular, cylindrical nested fluid heating chambers 11, 12 and 13, the adjacent ones of which are separated or spaced from one another by an annular catalytic heating zone 15 or 16. In the illustrated embodiment, three fluid heating chambers 11, 12 and 13 and two catalytic heating zones 15 and 16 are illustrated, however, additional fluid heating chambers and catalytic heating zones can be provided. The catalytic fluid heater 10 can be constructed of common metals such as steels or stainless steels, aluminum, copper, nickel, titanium and the like.

The circular, cylindrical fluid heating chambers 11, 12 and 13 are closed at both of their ends by a top wall 14 and a bottom wall 17. The annular catalytic heating zones 15 and 16 are opened at the top and extend through the bottom wall 17. The lower ends of the heating zones terminated in closely spaced relationship to respective ones of a pair of concentric rings 19 and 20 of a fuel manifold 18 mounted within a skirt portion 22 at the lower end of the catalytic fluid heater.

An active catalyst surface is applied to the annular walls forming the catalytic heating zones 15 and 16. Fuel gas is delivered to the manifold 18 and enters the heating zones 15 and 16 from the two concentric rings 19 and 20 mounted below them. Air enters through the air ports 21 in the skirt portion 22 and mixes with the rising fuel gas, aided by the chimney effect of the tall and relatively narrow annular heating zones. Without forced convection, this catalytic heater operating at atmospheric pressure requires the chimney effect to inspire the proper amount of excess air thus insuring completeness of combustion of the hydrogen and air or hydrogen-rich gas and air mixture. The mixture is combusted when it contacts the catalyst on the wall forming the heating zones. The extensions 28 and 29 of these heating zones below the fluid chambers 11, 12 and 13 in close proximity to the manifold 18 allow a relatively hot starting surface to insure proper operation from a cold start.

The fluid heater preferably and advantageously is fueled with hydrogen, reformed natural gas, or a low carbon monoxide content manufactured gas rich in hydrogen. The walls forming the heating zones are coated with a catalyst to combust such fuel gases in a flameless fashion. The catalyst can comprise any one of a number of commonly available noble metal catalysts, such as platinum, ruthenium, rhodium, palladium and their alloys, deposited on an alumina or anodized aluminum or other porous or high surface area material substrate, in the manner described more fully below. The substrate may be deposited directly on the fluid chamber walls, or preferably it may be an insert or liner placed adjacent to and in contact with these walls. Also, highly active non-precious metal oxide catalyst surfaces are acceptable. When fuel gases of this type are used, the primary (overall) chemical reaction occurring on the catalyst surface is: $H_2(g) + \frac{1}{2} O_2(g) \rightarrow H_2O\ (g)$.

Since the combustion product is water, external venting is not required. The catalyst surface temperature need not exceed 500°–600°F; and hence, oxides of nitrogen are not formed during the combustion. In addition, operation with engineering models proves that 1–2% carbon monoxide content in the fuel gas is also essentially combusted (to carbon dioxide). Also, the combustion is self-igniting and is flameless, so that no electrical energy is required to initiate combustion. Heat transfers through the catalyst and its substrate layer, and through the metal walls into the fluid which is in direct contact with the metal surface opposite the catalyzed surface. Hydrogen can be completely combusted with air over the catalyst even though the mixture composition is below the lower (lean) flammability limit. The height of the heating zones and the total catalyzed area thereof is sized so that better than 99% of the hydrogen in the fuel gas is oxidized to water vapor. The total heat transfer area may be sized so that the exhaust gas temperature is above water condensation conditions, but not dangerously hot. For normal water heating, exhaust temperatures can approximate 180°– 200°F, and immediate dilution by ambient air produces much cooler temperatures above the heater. Optionally, the heat transfer area may be sized for partial internal condensation of the combustion produced steam, and this condensate could be collected in a pan or trough below the water chambers. As more fully described below, an optional condenser above the heater produces distilled quality water and allows cooling of the exhaust gases (essentially nitrogen and air) to ambient conditions.

Figure 4:
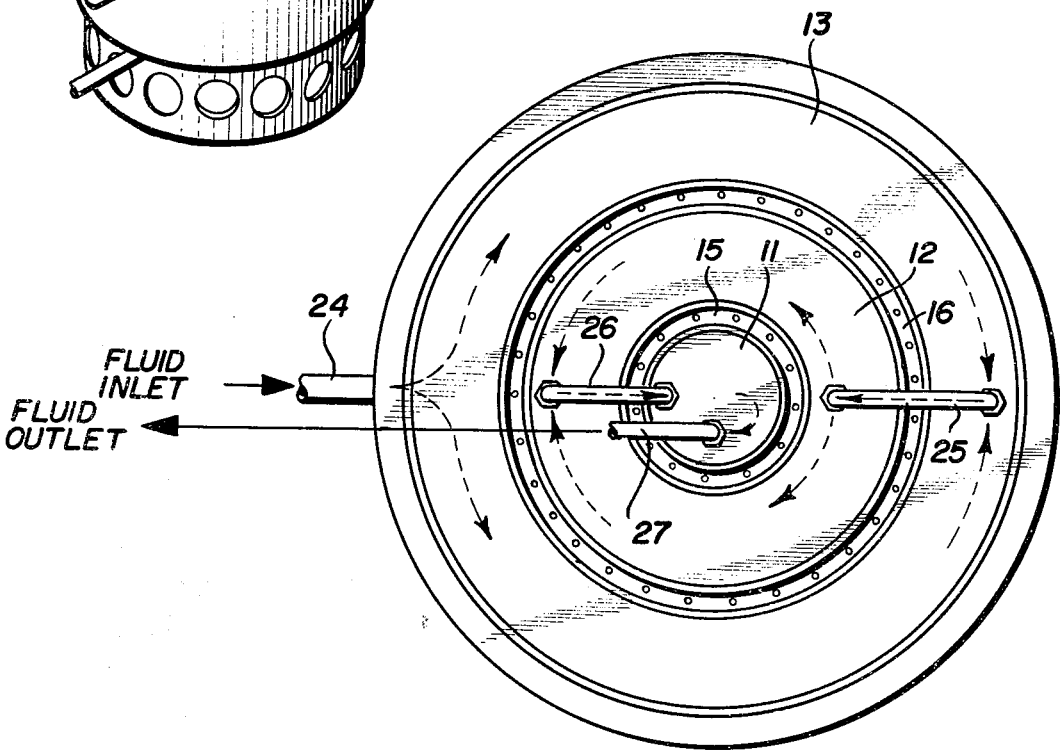
FIG. 4 is a top plan view of the catalytic heater.

As can be best seen in FIGS. 2 and 4, the cold fluid (e.g. water) enters the bottom of the outer annular heating chamber 13 and exists diametrically opposite at the top. From the top of the heating chamber 13, the fluid is delivered to the bottom of the second or middle chamber 12 via a downcomer 25. It exits diametrically opposite at the top and enters the center heating chamber 11 at its bottom from a downcomer 26. The fluid finally exits at the top near the center of the heater through a fluid outlet 27. This described flow pattern is exemplary, and other configurations are workable. Also, while a three fluid heating chamber unit is illustrated, any number of cylindrical fluid heating chambers can be employed depending on the heating requirements. The heater also may be a batch unit with intermittent heating cycles, or it may serve as a continuous flow unit, or it may be joined to a hot fluid storage tank mounted above or aside of it.

If exhaust steam condensing is desired, a pre-warming fluid circulator 29 is mounted above the heater and will remove the heat of condensation. The pre-warming fluid circulator includes a flat plate 30 which is mounted at an angle over the heater and a portion of the fluid inlet is convoluted and affixed to the surface of the metal plate 30. A water condensate collector tank is mounted below the drip point 32 of the flat plate 30, for collecting the distilled quality water produced on the surface of the plate as the fluid flows through the fluid inlet and the steam from the fluid heater 10 condenses on the plate.

The fluid heater design depends on the thermal properties and flow rates of the fluid, the required fluid temperature rise, the catalyst activity, the fuel gas composition, and the general shape or number of concentric chambers that are desired. Within limits, a tall and narrow heater (with two chambers) will give performance comparable to a short and wide heater (with three or more chambers). The capacity of a given heater can be increased by adding chambers and gas feed manifolds. It was found that catalyst surface spacings of one-eighth to one-fourth inch are satisfactory for combustion zone heights of 10 to 20 inches (for combusting reformed natural gas on platinum-catalyzed anodized aluminum). Generally, a combustion zone height to spacing ratio of 50 to 100 (or more) is necessary; higher activity catalysts allow lower ratios for given fuel gas input rates. The specific maximum combustion rate for complete combustion of reformed natural gas utilizing natural draft convection in this geometry fluid heater and using platinumcatalyzed anodized aluminum is about 7000 Btu/hr.ft$^2$. This rate could be increased by using pure hydrogen gas fuel or by using more active catalyst. Above this fuel gas flow rate uncombusted hydrogen begins to escape from the heater; however, below this rate the units exhibit better than 99% complete combustion (with infinite turn down control). The fuel gas flow can be moderated (proportionately controlled) or controlled in an on-off mode to meet heating demand.

A specific example of the fluid heater is a household water heating appliance which optionally humidifies the home (during warm or humid periods). A small two chamber engineering model has been constructed and tested for proof of concept. At a throughput of 4 gallons per hour (continuous flow of water), it requires a reformed gas feed rate of 3600 Btu per hour or about 14 cubic feet per hour (the reformed gas is 78% $H_2$ 20.5% $CO_2$, 1% $CH_4$, and 0.5% CO, with a high heating value of 260 Btu per cubic foot). The temperature rise in the water going through the unit is 80°F (60°F in 140°F out). Based on the high heating value of the fuel gas, the unit is 75% thermally efficient. Before steam condensation, the warm flue gas (150°–180°F) contains essentially air, steam, and nitrogen. The levels of carbon dioxide and oxides of nitrogen are negligible and essentially the same as ambient room air.

For the two chamber engineering model, the design parameters below were observed.

Fluid:

Water, specific heat = 1.0 Btu/lb °F
flow rate = 0 to 33 lb/hr

Catalyst surface:

Catalyzed aluminum inserts (sleeves) in contact with chamber walls. Catalyst is platinum applied to freshly anodized aluminum and heat treated. Catalyst loading is 0.00002 to 0.00004 oz/sq in (0.1 to 0.2 milligrams per square centimeter). Catalyzed surface area = 75 in$^2$ (0.52 ft$^2$).

Chamber spacing:

(spacing between catalyst surfaces in the annular combustion zone): one-fourth ± one-thirty-two inch.

Chamber height:

14 inches

Chamber diameters:

inner, 1.75 inches O.D.; outer, 2.25 inches I.D. and 4.25 inches O.D.

Total heat transfer area: 175 sq. in. (1.2 sq. ft.)

Measured overall heat transfer coefficient (based on water temperature rise):

25 –30 Btu/hr ft$^2$ °F.

From the above description, it can be seen that the fluid heater 10 is a flameless, catalytic fluid heater which can be used for warming water, oil, solvents, dispersions, slurries, etc. with negligible danger of flammability. The fluid heater preferably is fueled by hydrogen, or other gases which are rich in hydrogen such as reformed natural gas, and manufactured gas. The combustion is better than 99% complete, and the thermal efficiency is better than 75% based on the high heating value of hydrogen. The heater is unvented (requires no external chimney) because the exhaust is relatively cool and does not contain noxious or toxic gases significantly above ambient air levels. The exhaust gases contain water vapor which may be used for humidification or may be condensed to distilled quality water. If preheating of the fluid is used for condensation, the efficiency of the entire unit then approaches 100% of the high heating value of hydrogen.

While there are various methods which can be used to deposit the catalyst on the walls, during the design of the heater 10, a new technique was developed to support a platinum catalyst on metallic aluminum which allows for the catalyst to be permanently fixed to the metal such that no bonding agent is utilized and the catalyst will not rub off. Temperature limitations of bonding agent therefore are not a problem. The high surface area of a porous film applied to the metallic surface allows for the application of high activity catalyst that will self-ignite at room temperature.

The procedure developed incorporates an anodization technique. This technique involves the electrolytic oxidation of aluminum to $Al_2O_3$ on the surface of the metal. This is done by the following reaction mechanism:

$$2Al + 3H_2O \rightarrow Al_2O_3 + 3H_2$$

This produces a thin (less than 1 mil thick) porous high surface area film of aluminum oxide on the surface of the metal. Chloroplatinic acid can then be applied to this surface. The platinum can then be reduced with a soft flame to produce a high activity, self-igniting catalyst.

Specific Example

Aluminum was anodized using a 15% sulfuric acid electrolyte under the following conditions:

| | |
|---|---|
| Temperature | 25°C ± 2°C |
| Current Density | 30 AMPS/Sq ft A.C. |
| Voltage | 12–18 volts |
| Time | 1 hour |

This produced an aluminum oxide film of approximately 0.6 mils on the surface of the aluminum. A 10% solution (4% platinum) of chloroplatinic acid was applied to this surface and reduced with a soft flame. The catalyst was applied such that the cooling on the surface was in the range of 0.1 to 0.2 milligrams/sq. cm. The final surface was of a black-brown color exhibiting high activity and self-igniting characteristics.

It will thus be seen that the objects set forth above, among those made apparent from the preceding description, are efficiently attained and certain changes may be made in the above construction. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A catalytic fluid heater comprising a plurality of nested, fluid heating chambers spaced from one another to provide therebetween a heating zone, a catalyzed surface in contact with the walls of adjacent ones of said fluid heating chambers, and manifold means for delivering a fuel gas which is rich in hydrogen to said heating zones, said fluid heating chambers being proportioned to create a chimney effect to produce a fuel flow comprising said fuel gas and air through said heating zone from the bottom to the top thereof to effect contact with and combustion of said fuel on said catalyzed surface and to assure sufficient excess air inspiration for complete combustion, whereby heat is transferred through said catalyst and said walls to heat a fluid in said fluid heating chambers and innocuous combustion products result so that no external venting to the atmosphere is required.

2. The catalytic fluid heater of claim 1, wherein a catalyst is deposited directly on the wall of adjacent ones of said fluid heating chambers. walls

3. The catalytic fluid heater of claim 1, wherein a catalyst is deposited on an insert placed adjacent to and in contact with the walls of adjacent ones of said fluid heating chambers.

4. The catalytic fluid heater of claim 1, wherein said plurality of nested fluid heating chambers are circular, cyclindrical-shaped fluid heating chambers.

5. The catalytic fluid heater of claim 4, wherein the walls of adjacent ones of said fluid heating chambers extend below said fluid heating chambers in close proximity to said manifold means to provide a hot starting surface to insure proper operation from a cold start.

6. The catalytic fluid heater of claim 1, further including a condensor above said heater for producing distilled quality water and for cooling the exhaut gases to ambient conditions.

7. The catalytic fluid heater of claim 1, further including a fluid inlet in communication with the outermost one of said fluid heating chambers positioned adjacent the lower end thereof, a fluid outlet from the innermost one of said fluid heating chambers at the top end thereof, and water conduit means coupling adjacent ones of said fluid heating chambers in communication with one another positioned at the top ends thereof, whereby a fluid flowing into said heater through said fluid inlet circulates through said fluid heating chambers and exits from said heater through said fluid outlet.

8. The catalytic fluid heater of claim 7, further including downcomer means coupled with said water conduit means for delivering a fluid from the top of one fluid heating chamber into and discharging the fluid near the bottom of the adjacent one of said fluid heating chambers.

* * * * *

UNITED STATES PATENT OFFICE
CERTIFICATE OF CORRECTION

PATENT NO. : 3,955,556
DATED : May 11, 1976
INVENTOR(S) : Jon B. Pangborn and John C. Sharer It is certified that error appears in the above-identified patent and that said Letters Patent are hereby corrected as shown below:

Claim 2 should read as follows:

Claim 2. The catalytic fluid heater of claim 1, wherein a catalyst is deposited directly on the walls of adjacent ones of said fluid heating chambers.

Signed and Sealed this
Third Day of August 1976

[SEAL]

*Attest:*

RUTH C. MASON
*Attesting Officer*

C. MARSHALL DANN
*Commissioner of Patents and Trademarks*